United States Patent [19]

Yamaguchi et al.

[11] 4,395,984

[45] Aug. 2, 1983

[54] ELECTRONIC FUEL SUPPLY CONTROL SYSTEM FOR INTERNAL COMBUSTION ENGINES

[75] Inventors: Hiroshi Yamaguchi; Kenji Ikeura, both of Yokosuka, Japan

[73] Assignee: Nissan Motor Company, Limited, Yokohama, Japan

[21] Appl. No.: 190,500

[22] Filed: Sep. 25, 1980

[30] Foreign Application Priority Data

Sep. 28, 1979 [JP] Japan ..... 54-124171

[51] Int. Cl.[3] ..... F02D 31/00

[52] U.S. Cl. ..... 123/325; 123/493; 123/198 DB

[58] Field of Search ..... 123/325, 333, 198 DB, 123/493; 74/860

[56] References Cited

U.S. PATENT DOCUMENTS

| | | | |
|---|---|---|---|
| 3,349,644 | 10/1967 | Gish | 123/325 X |
| 3,809,028 | 5/1974 | Luchaco | 123/493 |
| 3,906,207 | 9/1975 | Rivere et al. | 123/333 X |
| 4,201,161 | 5/1980 | Sasayama et al. | 123/493 |
| 4,204,483 | 5/1980 | Harada et al. | 123/493 |
| 4,285,314 | 8/1981 | Kiencke et al. | 123/325 X |
| 4,305,365 | 12/1981 | Iizuka et al. | 123/325 |

FOREIGN PATENT DOCUMENTS

| | | |
|---|---|---|
| 1601366 | 10/1970 | Fed. Rep. of Germany . |
| 1538277 | 1/1979 | United Kingdom . |
| 2006989 | 5/1979 | United Kingdom . |

*Primary Examiner*—William A. Cuchlinski, Jr.

*Attorney, Agent, or Firm*—Schwartz, Jeffery, Schwaab, Mack, Blumenthal & Koch

[57] ABSTRACT

An electronic fuel supply control system for internal combustion engines which carries out the engine fuel cutoff while the engine is decelerated either with a predetermined delay or immediately depending on engine driving conditions, and preferably on the state of the transmission, thus reducing the jolt produced when the fuel cutoff is carried out.

11 Claims, 4 Drawing Figures

ELECTRONIC FUEL SUPPLY CONTROL SYSTEM FOR INTERNAL COMBUSTION ENGINES

BACKGROUND OF THE INVENTION (1) Field of the Invention

The present invention relates generally to a fuel supply control system for an internal combustion engine of an automotive vehicle, and, more specifically, to a fuel supply control system which controls the air and fuel mixture for the engine according to various engine operating conditions obtained from various sensed information in order to reduce pollution from the exhaust gas.

(2) Description of the Prior Art

In a fuel supply control system of an internal combustion engine of an automotive vehicle (e.g., electronic fuel injection control system, electronic carburetor, etc.), there may be provided a fuel cutoff function during deceleration in order to improve exhaust gas purification and reduce fuel consumption and prevent a catalytic converter in the exhaust manifold of the engine from burning out.

The fuel cutoff is carried out during deceleration of the automotive vehicle depending upon whether particular engine operating conditions are satisfied; e.g., whether the throttle valve in the intake manifold is in the idling position, the engine rotational speed is above a predetermined value, and the cooling water temperature is above a predetermined value. Although in the above-described control system the fuel supply is cut off and restored depending upon the operating conditions of the automotive vehicle, when the fuel supply is cut off or restored this causes a change in the driving torque for the vehicle. Consequently, the vehicle occupants are often subjected to undesirable jolting, particularly, in low gear where the driving torque is relatively large so that the change in the torque produces a sizeable jolt.

BRIEF SUMMARY OF THE INVENTION

It is an object of the present invention to provide a fuel supply control system for an automotive engine which carries out fuel cutoff with a delay from the time when a decision to cut off fuel is made. In this way jolting and vibration due to fuel cutoff is avoided.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The features and advantages of the fuel supply control system for an automotive engine according to the present invention will be more clearly appreciated from the following description of a preferred embodiment thereof taken in conjunction with the attached drawings in which like reference numerals designate corresponding elements, and in which.

DETAILED DESCRIPTION OF THE PREFERRED EMBODIMENT

Figure 1:
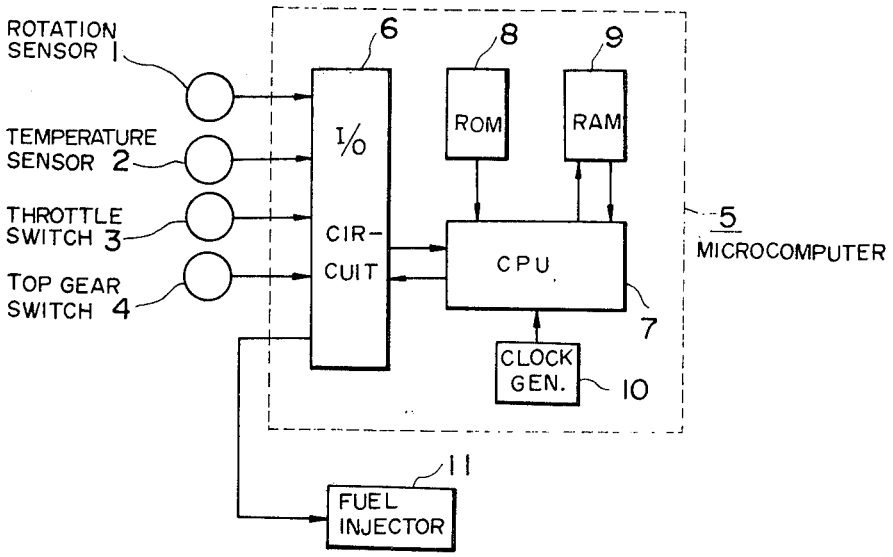
FIG. 1 is a simplified block diagram of a preferred embodiment of the present invention.

Referring now to the drawings, and particularly to FIG. 1, numeral 1 designates a rotation sensor for detecting the rotational engine speed, e.g. a crank angular sensor for outputting a series of pulses every time the crankshaft rotates through a particular angle. Numeral 2 denotes a temperature sensor for detecting the temperature of the cooling water around the engine, e.g., a thermistor provided within a water jacket. Numeral 3 denotes a throttle switch for detecting whether the throttle valve is completely closed. Numeral 4 denotes a top gear switch for detecting whether the transmission is in top gear. Numeral 5 denotes a microcomputer which comprises substantially an input/output circuit 6, a central processing unit 7 (CPU), a read only memory 8 (ROM), a read/write memory 9 (RAM) and a clock generator 10 for outputting a timing signal to which the execution of arithmetic operation is referred.

Numeral 11 denotes a fuel injection valve located at the intake manifold under a constant pressure, whose valve opening time is so controlled as to determine the fuel injection rate to the engine cylinders.

Figure 2:
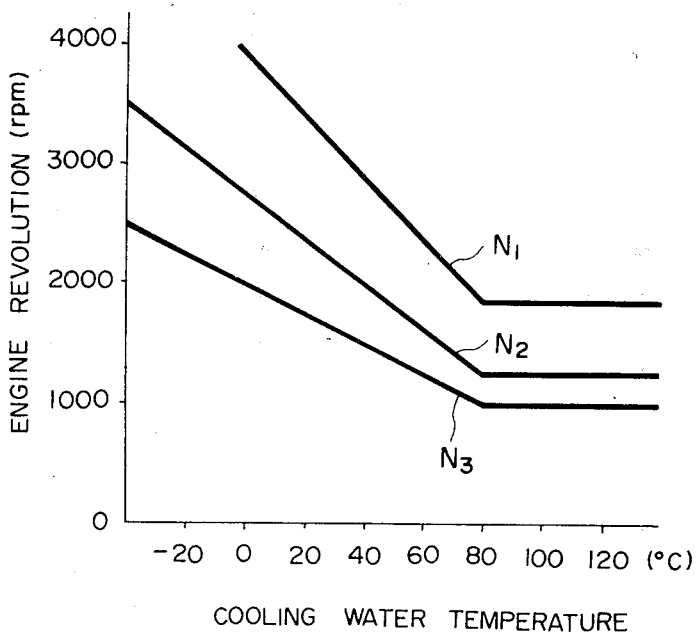
FIG. 2 is a graphical representation of engine rotational speed (in rpm) versus cooling water temperature (in °C.)

The microcomputer 5 performs arithmetic operations on the basis of the input signals from each of the rotational sensor 1, temperature sensor 2, throttle switch 3 and top gear switch 4 and the fuel is cut off when either of the following conditions is satisfied:

(1) The throttle valve is in the fully closed position and the engine speed decreases from above N2 as illustrated in FIG. 2; or (2) At the time when the throttle valve is closed the engine rotational speed starts to increase from above N2 as illustrated in FIG. 2 as in the case when the vehicle is descending a hill slope.

When either of (1) and (2) is satisfied, the fuel cutoff is carried out immediately provided that the transmission is in top gear. If not in top gear, the fuel cutoff is carried out after a predetermined time delay or after the engine has rotated a predetermined number of rotations.

In this way, the fuel cutoff delay becomes shorter in time in a predetermined way from the time when the fuel cutoff condition is satisfied, thereby reducing the jolt received at the time when the fuel cutoff is carried out. Furthermore, if the time during which the throttle valve is completely closed is shorter than the time delay, the fuel cutoff is not carried out at all. Therefore, if the throttle valve is repeatedly opened and closed to maintain the vehicle speed constant while the vehicle is moving at a low speed the fuel will not be cut off and unpleasant jolting will be avoided.

Furthermore, when the transmission is in top gear, the driving torque is less and the jolt is reduced so that the fuel cutoff can be carried out without delay.

On the other hand, if the engine speed goes below N3 shown in FIG. 2 or the throttle valve is opened, the fuel supply is restored. The fuel cutoff is carried out by interrupting the control signal (injection pulses) which drives the fuel injection valve 11.

Figures 3A, 3B:
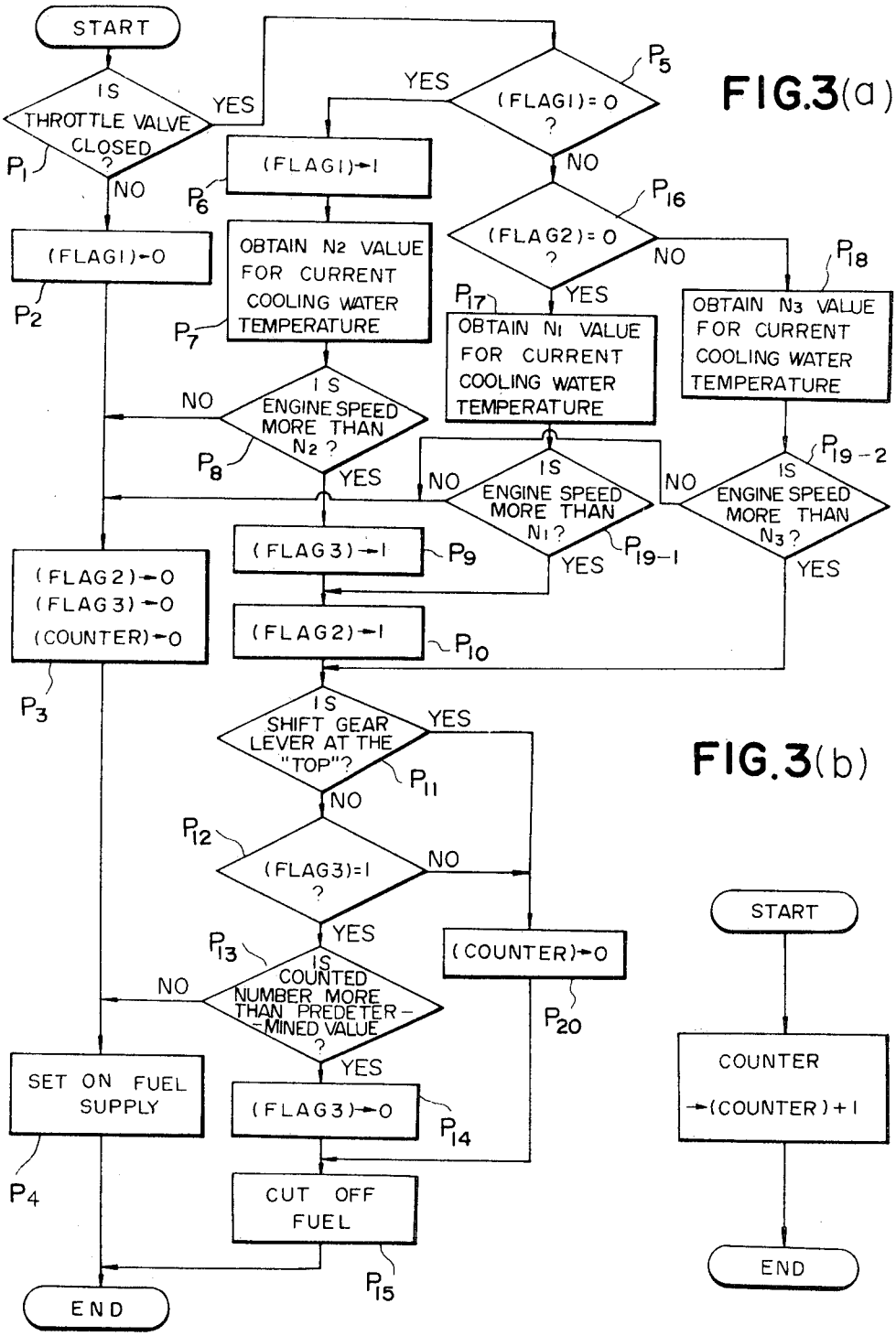
FIGS. 3(*a*) and (*b*) are flowcharts of fuel cutoff according to the present invention.

Referring now to FIG. 3, the following describes how the microcomputer 5 executes arithmetic operations.

FIG. 3(*a*) is a flowchart showing a routine to determine whether the fuel should be cut off or not.

FIG. 3(*b*) is a flowchart showing a routine to count the time delay.

In FIG. 3(*a*), Flag 1 is set to indicate whether the throttle valve is completely closed or not at the end of each execution of the routine shown in FIG. 3(*a*). If Flag 1 is 1, the throttle valve is completely closed. If Flag 1 is 0, the throttle valve is not completely closed. Flag 2 is set in each execution to indicate whether the microcomputer has determined conditions for the carrying out of fuel cutoff. If Flag 2 is 1, the microcomputer has determined fuel cutoff. If Flag 2 is 0, the microcomputer has determined not to carry out fuel cutoff. Flag 3 is set to indicate whether the fuel cutoff is currently being delayed or not. If Flag 3 is 1, the fuel cutoff is now being delayed. If Flag 3 is 0, the fuel cutoff is not now being delayed.

First, in step P1 the microcomputer determines whether the throttle valve is completely closed or not. If not, the microcomputer sets Flags 1, 2 and 3 and the counter to zero in steps P2 and P3. The microcomputer then sets the fuel supply on in step P4.

On the other hand, if the throttle valve is completely closed, the microcomputer checks to see if Flag 1 is 1 or not in step of P5. If Flag 1 is 0, the throttle valve was not completely closed in the preceding execution but is completely closed in this execution, and in this case after Flag 1 is set to 1 in step P6, the microcomputer obtains the value of N2 (N2 characteristic solid line shown in FIG. 2) corresponding to the current cooling water temperature. In step P8, the microcomputer determines whether the engine speed is more than N2. If the answer is "no" in step P8, the engine speed does not comply with the condition (2) as described above, so the microcomputer goes to steps P3 and P4 setting the fuel supply on. If the answer is "yes" in step P8, Flag 3 and Flag 2 are set to 1 in steps P9 and P10.

Next, the microcomputer determines whether the transmission is in top gear or not in step P11. If in top gear, the counter is cleared immediately in step P20 and the microcomputer cuts off the fuel supply in step P15.

On the other hand, if not in top gear, the microcomputer reads the value of Flag 3 in step P12. If Flag 3 is 0, the fuel cutoff is not now being delayed and the counter is cleared in step P20 and the microcomputer goes to the step P15 immediately. If Flag 3 is 1 in step P12, the fuel cutoff is now being delayed. In this case, the microcomputer checks to see in step P13 whether the counter value has reached a predetermined value or not. If the answer is "no" in step P13, the fuel cutoff delay is now being carried out, that is, the predetermined delay has not elapsed. In this case, the microcomputer sets the fuel supply on in step P4. If the answer is "yes" in step P13, it indicates that the predetermined time has elapsed. After Flag 3 is set to 0 in step P14, the microcomputer carries out the fuel cutoff in step P15.

If Flag 1 is 0 in step P5, the throttle valve is in the completely closed state. In this case, the microcomputer reads the state of Flag 2 in step P16. If Flag 2 is 0, it indicates the microcomputer did not make a decision to cut off the fuel in the previous execution.

In this case, the microcomputer obtains the N1 value (N1 characteristic solid line as shown in FIG. 2) corresponding to the cooling water temperature at that time and checks to see whether the engine speed is at least N1 or not in step P19-1. If the engine speed is less than N1 in step P19-1, the condition (1) described above is not satisfied, and the microcomputer goes to step P4 via step P3 and decides not to carry out fuel cutoff. If the engine speed exceeds N1 in step P19-1, the condition (1) described above is satisfied, and the microcomputer proceeds to step P10. In this case, steps from P10 are executed in the same way as described above, but since Flag 3 is 0, at step P12 the microcomputer determines an immediate fuel cutoff without any delay. In other words, if the rotation number exceeds N1 while the throttle valve is completely closed, an immediate fuel cutoff is carried out, because, for example, when the automotive vehicle is going downhill, the jolting to be received is greatly reduced.

If Flag 2 is 1 in step P16, it means that the microcomputer has decided to cut off the fuel in the previous execution. In step P18, the microcomputer obtains the value N3 for the current cooling water temperature. In step P19-2, the microcomputer checks to see whether the engine speed is equal to or greater than the value of N3 obtained in step P18. If the answer is "no" in step P18, the engine speed is less than the value of N3 and satisfies the condition to end the fuel cutoff, so that the microcomputer goes to steps P3 and P4 and restores the fuel supply. If the answer is "yes" in step P19-2, the microcomputer goes to step P11 and its following steps where the fuel cutoff is continued.

In the routine shown FIG. 3(*a*), when the transmission is other than in top gear, the engine speed is greater than or equal to the value of N2, and the throttle valve is turned to the fully closed state, in this execution the microcomputer runs exactly once through the processing sequence P1 - P5 -P6 - P7 - P8 - P9 -P10 - P11 - P12 - P13 -P4. After the end of this processing sequence, the microcomputer runs through the processing sequence P1 - P5 - P16 - P18 -P19-2 -P11 - P12 - P13 - P4 until the counter value of the counter exceeds a predetermined value (if the predetermined value is in units of time, it may correspond to from 0.1 sec to 0.5 sec and if in units of rotation, 2 to 10 revolutions), and thus a predetermined delay is brought about.

When the counter value reaches a predetermined value corresponding to the predetermined delay, the microcomputer runs exactly once through the processing sequence P1 - P5 - P16 - P18 - P19-2 - P11 -P12 - P13 - P14 - P15. Next the microcomputer changes the processing sequence to P1 - P5 -P16 - P18 - P19-2 -P11 - P12 -P20 - P15. If the transmission is in top gear, the last two sequences are terminated instead by P11 - P20 - P15. In this case, the microcomputer cuts off the fuel without any delay.

FIG. 3(*b*) shows a routine for the counter which is incremented by one each time the routine shown in FIG. 3(*a*) is executed. Therefore, if the arithmetic operation is carried out at fixed time intervals (synchronized with clock pulses of a fixed frequency), the counted value is proportional to time. On the other hand, in the case where the arithmetic operation is carried out at intervals of a predetermined number of engine rotations (synchronized with clock pulses corresponding to the engine rotation), the counted value is proportional to the total number of engine revolutions.

The flowcharts of FIGS. 3(*a*) and (*b*) exemplify the arithmetic operation in the case where a delay is not provided if the transmission is in top gear. If step of P11 is omitted, the delay can be provided regardless of the state of the transmission.

Furthermore, if the limit value for the counter is varied according to the driving conditions of the engine (for example, the delay time is made longer when the engine is rotating at high speed), the delay time can be adapted to different values appropriate for the driving conditions.

According to the present invention the fuel cutoff for the internal combustion engine is carried out after a predetermined delay jolt produced when the fuel is cut off can be greatly reduced.

The delay is preferably, though not necessarily, provided only when the transmission is in lower gears. In the preferred embodiment described this distinction is made by determining whether the transmission is in top gear, but of course according to circumstances the distinction may be made between two lower gears or may be based on other criteria such as the vehicle speed. It will be understood by those skilled in the art that this and other similar modifications may be made in the preferred embodiment described above without departing from the spirit and scope of the present invention, which is to be defined by the appended claims.

What is claimed is:

1. A fuel supply control system, for an internal combustion engine having an associated transmission, which cuts off the fuel supplied to said engine during deceleration conditions, comprising:

(a) first means for determining when an engine fuel cutoff condition is satisfied;

(b) second means, operative in response to a fuel supply cutoff determination from said first means, for setting a delay in effecting the actual fuel cutoff depending upon instantaneous engine operation; and (c) third means for cutting off the fuel supplied to the engine, either immediately in response to a fuel cutoff determination from said first means or after a delay set by said second means, depending upon instantaneous transmission operation.

2. The fuel supply control system of claim 1, further comprising (d) fourth means for detecting fuel cutoff conditions, in which said second means is activated selectively according to at least one of the sensed fuel cutoff conditions.

3. The fuel supply control system of claim 2, in which said fourth means includes a means for the detection of the state of a transmission.

4. The fuel supply control system of claim 3, in which said second means is activated when said fourth means detects that the transmission is in a lower speed range.

5. The fuel supply control system of claim 4, in which said second means is activated when said fourth means detects that the transmission is not in the top speed range.

6. The fuel supply control system of claims 2 or 3 or 4 or 5, in which the delay is a predetermined accumulated interval of time.

7. The fuel supply control system of claims 2 or 3 or 4 or 5, in which the delay is a predetermined number of engine revolutions.

8. The fuel supply control system of claim 2, in which said second means is activated when said fourth means detects that a throttle valve of the engine is fully closed and the instantaneous engine speed exceeds a first predetermined value, said first predetermined value being based on the engine cooling water temperature and being higher than a predetermined value which establishes resumption of the fuel supply.

9. The fuel supply control system of claim 2, in which said second means is not activated when said fourth means detects that the instantaneous engine speed decreases from below a first predetermined value with the throttle valve fully closed.

10. The fuel supply control system of claim 2, in which said second means is activated when said fourth means detects that the instantaneous engine speed increases from below a first predetermined value and becomes above a second predetermined value, with the throttle valve fully closed.

11. The fuel supply control system of claim 2, in which said second means is activated when said fourth means detects that the instantaneous engine speed increases from above a first predetermined value, with the throttle valve fully closed.

* * * * *